US012114778B2

(12) United States Patent
Brun et al.

(10) Patent No.: US 12,114,778 B2
(45) Date of Patent: Oct. 15, 2024

(54) FOLDABLE BED

(71) Applicant: Nicolas Brun, La Tour d'Aigues (FR)

(72) Inventors: Nicolas Brun, La Tour d'Aigues (FR); Luc Josancy, Saint Cyr sur le Rhone (FR)

(73) Assignee: POYET MOTTE PUERICULTURE, Cours la Ville (FR)

( * ) Notice: Subject to any disclaimer, the term of this patent is extended or adjusted under 35 U.S.C. 154(b) by 87 days.

(21) Appl. No.: 15/535,041

(22) PCT Filed: Sep. 18, 2015

(86) PCT No.: PCT/FR2015/052517
§ 371 (c)(1),
(2) Date: Jun. 10, 2017

(87) PCT Pub. No.: WO2016/042279
PCT Pub. Date: Mar. 24, 2016

(65) Prior Publication Data

US 2017/0367488 A1 Dec. 28, 2017

(30) Foreign Application Priority Data

| | | |
|---|---|---|
| Sep. 19, 2014 | (FR) | 1458889 |
| Sep. 19, 2014 | (FR) | 1458890 |
| Mar. 10, 2015 | (FR) | 1551988 |

(51) Int. Cl.

| | |
|---|---|
| ***A47C 19/12*** | (2006.01) |
| ***A47D 7/00*** | (2006.01) |
| ***A47D 13/06*** | (2006.01) |

(52) U.S. Cl.
CPC ..... *A47C 19/126* (2013.01); *A47D 13/063* (2013.01); *A47D 13/066* (2013.01);
(Continued)

(58) Field of Classification Search
CPC .... A47D 13/061; A47D 13/063; A47D 7/002; A47D 7/124; A47D 7/12; A47D 13/066;
(Continued)

(56) References Cited

U.S. PATENT DOCUMENTS 6,256,814 B1 * 7/2001 Drobinski ..... A47D 13/063 248/169
6,317,907 B1 * 11/2001 Wang ..... A47D 13/063 5/93.1

(Continued)

*Primary Examiner* — Justin C Mikowski
*Assistant Examiner* — Morgan J McClure
(74) *Attorney, Agent, or Firm* — Patshegen IP; Moshe Pinchas

(57) ABSTRACT

A foldable bed (50) comprising:
a foldable frame (505) along at least one axis comprising a foldable rod (510),
at least two legs (515), each leg being attached to the frame by a connection (520), said connection allowing for the positioning of said leg according to an unfolded position and a folded position and
the foldable rod being associated with each connection on either side of the folding axis,
in which:
each connection comprises an orifice (525) passing through said connection and
each leg has an attachment (530) to a flexible wire (535) connecting two legs and passing through the folding axis of the frame, the wire being tensioned when the rod is unfolded, the tension of the wire causing the positioning of the legs in the unfolded position.

20 Claims, 11 Drawing Sheets

(52) U.S. Cl.
CPC ..... *A47C 19/122* (2013.01); *A47C 19/124* (2013.01); *A47D 7/002* (2013.01)

(58) Field of Classification Search
CPC .... A47C 19/124; A47C 19/122; A47C 19/126
See application file for complete search history.

(56) References Cited

U.S. PATENT DOCUMENTS 7,043,779 B2 * 5/2006 Mendenhall ..... A47D 13/063 16/324
7,661,156 B2 * 2/2010 Thorne ..... A47D 13/063 5/99.1
7,909,703 B1 * 3/2011 Semrau ..... A63G 31/00 446/487
7,937,786 B2 * 5/2011 Bergkvist ..... A47D 13/063 5/99.1
9,848,714 B2 * 12/2017 Burns ..... A47D 13/063
10,463,170 B2 * 11/2019 Lange ..... A47D 7/002
2005/0034232 A1 * 2/2005 Martin ..... A47D 7/02 5/95
2005/0217026 A1 * 10/2005 Ramirez ..... A47C 21/08 5/93.1
2007/0017025 A1 * 1/2007 Myer ..... A47D 7/002 5/99.1
2007/0095990 A1 * 5/2007 Park ..... A47C 17/70 248/200
2008/0271244 A1 * 11/2008 Bergkvist ..... A47D 13/063 5/99.1
2010/0218311 A1 * 9/2010 Rivera ..... A47D 13/063 5/99.1
2015/0021453 A1 * 1/2015 Brassard ..... A47D 13/063 248/544
2016/0183698 A1 * 6/2016 Szymanski ..... A47D 13/063 5/99.1

* cited by examiner

FOLDABLE BED

FIELD OF ART OF THE INVENTION

The aim of the invention is a folding bed and recliner. It applies in particular to mobile, folding and unfolding furniture for children.

PRIOR ART

The quality of a portable foldable bed is measured according to three main criteria:

the weight of the bed, the volume of the bed when it is folded, the time required to fold/unfold the bed.

In current systems, beds referred to as "umbrella" are unfolded by unfolding four joints, respectively positioned at the center of four rods defining a frame and then by pressing an unfoldable base. This unfoldable base, when unfolded, serves as support for a mattress and stiffener between the legs associated with the corners of the frame. These systems have the adverse effect of being heavy in particular due to the unfolding base.

In other current systems, such beds comprise a frame foldable along one axis, supported by legs, to which a support is suspended to form a bed. These systems have the adverse effect of occupying a large volume, when folded, which makes the bed bulky.

Thus, current systems do not respond satisfactorily to the requirements of the volume of the foldable bed when folded and the weight of the bed.

With respect to deckchairs for young children, non-dismountable systems exist formed by a fabric mounted on metal rods allowing the fabric to open out. These systems have the disadvantage of being very bulky, both in terms of weight and volume.

Some systems compensate for this adverse effect of bulkiness by having foldable rods along an axis in order to align the rods with the fabric tensioned in the folded position. These systems however still have an adverse effect of minimal bulkiness due to the frame around the fabric.

Thus, there is no current system that responds adequately to the constraint of the recliner's bulkiness, which renders its transportation inconvenient for a user.

AIM OF THE INVENTION

The present invention aims to overcome some or all of these adverse effects. Therefore, in one aspect, the aim of the present invention is a foldable bed comprising:

- a frame that can be folded according to at least one axis comprising a foldable rod,
- at least two legs, each leg being attached to the frame by a connection, said connection allowing said leg to be positioned in an unfolded position and in a folded position and
- the foldable rod being associated with each connection on either side of the folding axis, in which:

- each connection comprises an orifice that passes through said connection and
- each leg comprises an attachment to a flexible wire linking two legs and passing through the folding axis of the frame, the wire being tensioned when the rod is unfolded, the tension of the wire moving the legs to be positioned in the unfolded position.

Thanks to these arrangements, the extension of the legs is mechanically automated by unfolding the foldable rod. These arrangements thus reduce the time required to deploy the foldable bed in addition to allowing the foldable bed to be of reduced weight compared with systems in which the legs are engaged with the connections.

In alternative embodiments, at least one orifice has a shape, mechanically complementary to the shape of one end of the leg associated with said connection, said connection being configured to fit with said end.

These embodiments allow a better engagement between the leg and the connection when the wire is tensioned.

In alternative embodiments, the orifice has a concave shape, one opening of the connection being roughly positioned at the deepest point of said concave shape, another opening being formed by the base of the concave shape.

The advantage of these embodiments is that they allow a better engagement between the leg and the connection when the wire is tensioned.

In alternative embodiments, the orifice has the general shape of a cone, the base of the cone being oriented towards the leg end associated with the connection, one opening of the orifice being positioned at the top of the cone.

The advantage of these embodiments is that they allow a better engagement between the leg and the connection when the wire is tensioned.

In alternative embodiments, the connection includes, on one side, a longitudinal slot connecting two openings of the orifice, this slot having a cross-sectional width smaller than the width of the wire passing through the orifice.

These embodiments have the advantage of enabling the withdrawal of the wire from the orifice by a user exerting a tensile force on the wire.

In alternative embodiments, the foldable rod comprises two straight, rigid rod sections each associated with a connection, with lengths of the same order of magnitude, connected by a joint in order to:

- align the two rod sections along the length of these rod sections when the joint is unfolded and
- juxtapose the two rod sections when the joint is folded.

The advantage of these embodiments is that they allow the wire to be maintained in a state of tension when the joint is unfolded.

In a second aspect, the aim of the present invention is a bed, which comprises:

- at least three legs supporting a frame and
- a flexible support, suspended to the frame in a volume delimited by the legs, the floor and the frame, having an upper opening at the level of the frame and
- on one lateral side of the support, opposite a volume delimited by two legs, an opening means, a lateral opening, on said lateral side.

Thanks to these arrangements, the flexible support can be opened both laterally and vertically to allow a child to freely come and go to and from the support. When the child must be kept in the support, a user can freely close the lateral opening.

In alternative embodiments, a lower portion of the support is coplanar with the plane formed by the lower ends of each leg.

These embodiments allow the support to be positioned in contact with the ground, which facilitates the child's passage through the lateral opening.

In alternative embodiments, the opening means comprises:

- a vertical slide fastener passing through the lateral side and at least one horizontal slide fastener along a lower portion of the support.

These embodiments allow the bed to be easily made and the opening or closing of the lateral opening intuitive for a user.

In alternative embodiments, the bed to which the present invention relates comprises at least one rod attached to the frame and forming a support for the bed roof.

These embodiments allow the installation of a bed roof to protect the child from the sun or to facilitate the child's sleep.

In alternative embodiments, the bed to which the present invention relates comprises at least two rods connected by an end forming, in the folded position, a parallel bundle of rods.

These embodiments allow the rods to be easily carried when the bed is to be transported. This advantage is more pronounced when the bed corresponds to a foldable bed to which the present invention relates.

In alternative embodiments, the bed to which the present invention relates comprises a bed roof configured to cover at least the frame and the upper opening of the flexible support.

These embodiments, when opened laterally, form a shelter for the child when not used as a bed. Thus, it is possible for a user, according to the positioning of the roof and the opening or closing of the lateral opening, to use the bed for several functions. This flexibility in use limits the user's need to acquire two distinct objects. In a third aspect, the aim of the present invention is a foldable bed which comprises:

four legs, a frame comprising:

two rods, referred to as "long", each comprising two straight, rigid rod sections, referred to as "primary", with lengths of the same order of magnitude, connected by a joint, referred to as "primary", in order to:

align the two primary rod sections along the length of the rod sections when the primary joint is unfolded and juxtapose the two primary rod sections when the primary joint is folded, two rods, referred to as "short", shorter than the long rods, each comprising two straight, rigid rod sections, referred to as "secondary", with lengths of the same order of magnitude, connected by a joint, referred to as "secondary", in order to:

align the two secondary rod sections along the length of the rod sections when the secondary joint is unfolded and juxtapose the two sections of secondary rods when the secondary joint is folded, four joints, referred to as "tertiary" between a short rod and a long rod, each tertiary joint being configured such that:

when the tertiary joint is folded, they juxtapose said short rod and said long rod and when the tertiary joint is unfolded, position said short rod and said long rod roughly perpendicularly, four joints, referred to as "quaternary", each attached to a section of the primary or secondary rod, each quaternary joint being associated with a leg and configured such that:

when the quaternary joint is folded, it positions said leg in a position roughly parallel to said section of the primary rod and when the quaternary joint is unfolded, it positions said leg in a position roughly perpendicular to said section of primary rod and a flexible support comprising an attachment to the frame to attach the support to the frame when the primary, secondary and tertiary joints are unfolded.

Thanks to these arrangements, the volume of the folded foldable is reduced, the largest dimension of the folded foldable bed being equal to the greatest length of the legs or length of the section of primary rod. In addition, the absence of a rigid base allows the foldable bed to have a reduced weight compared with current systems. Finally, the use of joints facilitates and accelerates folding/unfolding the bed.

In alternative embodiments, each leg has a length roughly equal to the length of a section of primary rod.

These embodiments optimize the volume of the folded foldable bed, especially with respect to the largest dimension of the folded foldable bed corresponding both to the leg length and the length of the primary rod sections.

In alternative embodiments, the support is a surface, referred to as "main", suspended to the frame, said surface comprising a means of attachment to the base of at least one leg when said leg is unfolded.

The advantage of these embodiments is that they allow, on the one hand, the embodiment of a foldable bed with barriers and, secondly, stiffen the support.

In alternative embodiments, the support comprises an additional surface, suspended from the frame, positioned above the main surface.

These embodiments have the advantage of producing a double bottom facilitating the handling of a child present in the bed.

In alternative embodiments, the additional surface can be removed and rolled up, the support comprising a means for attaching the additional surface.

The advantage of these embodiments is that they allow modularity in the depth of the support.

In alternative embodiments, which comprise a means of locking comprising a push-button configured such that, when a pressure is applied to the button, it allows the transition of the secondary joint from an unfolded position to a folded position.

The advantage of these embodiments is that the unlocking of the locking device is made difficult for a child because of the strength and coordination necessary, on the one hand, to unlock the folding mechanism and, on the other, to fold the secondary joint simultaneously when the push-button is pressed.

In alternative embodiments, the foldable bed to which the present invention relates comprises an opening/closing means of the support.

The advantage of these embodiments is that they allow a child present in the foldable bed to leave it without needing to be extracted by a user outside the support.

In alternative embodiments, at least one primary and/or secondary joint is of ellipsoidal shape, this joint being mechanically attached to a primary or secondary rod, associated with said joint, said joint having a slot for the displacement of the other rod associated with said joint about an axis perpendicular to the plane formed by the said two rods.

These embodiments stiffen each joint implementing these features in order to strengthen the frame.

In alternative embodiments, the foldable bed to which the present invention relates comprises a mesh comprising an attachment to the frame to secure the so support to the frame when the rods of the frame are unfolded.

The advantage of these embodiments is that they allow the mesh to serve as a mosquito net, for example.

In a fourth aspect, the aim of the present invention is a folding recliner comprising:

a fabric attached to two rods, two flexible slat supports each comprising at least one removable attachment to a slat and four fasteners of a slat or support to one end of a different rod to form a rigid frame.

With these arrangements, the fabric can be wrapped around the supports when each slat is not attached to a support, which allows the recliner dimensions to be of minimum size in the folded position. Moreover, this foldable recliner has a smaller weight than current systems.

In alternative embodiments, each support comprises at least one housing for a slat, each slat sliding in a housing from a retracted position in the housing, to an unfolded position.

These embodiments allow the recliner dimensions to be of minimum size in the folded position.

In alternative embodiments, the length of each assembly formed by a slat support and each associated slat is greater than the maximum spacing length between the rods.

These embodiments make it possible to form a recliner support on a surface by the arched frame formed by the slats.

In alternative embodiments, each slat support comprises an unfoldable leg associated by a hinge to said support.

These embodiments make it possible to tilt the recliner, making it possible in particular to vary the positioning of a child positioned against the fabric.

In alternative embodiments, at least one rod is telescopic.

These embodiments make the recliner more compact in the folded position.

In alternative embodiments, the connection between the fabric and the rods is removable.

These embodiments make it possible to clean and handle the fabric without so handling the rods.

In alternative embodiments, the fabric comprises a harness.

These embodiments make it possible to keep a child in position, for example.

In alternative embodiments, the recliner to which the present invention relates comprises a support arch for movable elements suspended above the fabric.

These embodiments allow a child to play with suspended mobiles.

In alternative embodiments, the recliner to which the present invention relates comprises a removable protective awning fixable to the fabric or slat supports, covering at least part of the fabric.

These embodiments provide protection from the wind and sun for a child positioned on the fabric.

In alternative embodiments, the recliner to which the present invention relates comprises a mesh fabric attached to the awning and fabric, covering another part of the fabric than the part covered by the awning.

These embodiments provide more protection from the wind and sun for a child positioned on the fabric.

In alternative embodiments, the mesh fabric is impregnated with insecticide.

These embodiments make it possible to protect the child from the intrusion of insects in the volume covered by the mesh fabric.

In alternative embodiments, the recliner to which the present invention relates includes a means for detecting the temperature near or on the recliner and a means of signaling information representative of the detected temperature.

These embodiments make it possible to warn a nearby user of the temperature close to or on the recliner, which temperature can affect the health of a child positioned in the recliner for example.

In alternative embodiments, the recliner to which the present invention relates comprises an image sensor attached to a slat-support and means of transmitting the captured images.

These embodiments allow remote monitoring of the recliner and its surroundings.

In alternative embodiments, the recliner to which the present invention relates comprises a means of orienting the controlled image sensor depending on the reception of a steering command.

These embodiments make it possible for a user to remotely control the orientation of the image sensor.

BRIEF DESCRIPTION OF FIGURES

Other advantages, aims and special features of the invention emerge from the following non-limiting description of at least one embodiment of the foldable bed and of the process to which the present invention relates, opposite the appended drawings in which.

DESCRIPTION OF ILLUSTRATIVE EMBODIMENTS OF THE INVENTION

This description is non-exhaustive.

The term "Length" refers to the biggest side of a rectangular parallelepiped in which there is an object.

The term "same order of magnitude" between two values refers to a ratio between the two values ranging from $\sqrt{10}$ to $1/\sqrt{10}$.

The term "align" two elements refers to a positioning in which the angle between the two elements is less than 30 degrees. Preferably, this angle is less than 20 degrees. Preferably, this angle is less than 10 degrees.

Figure 1:
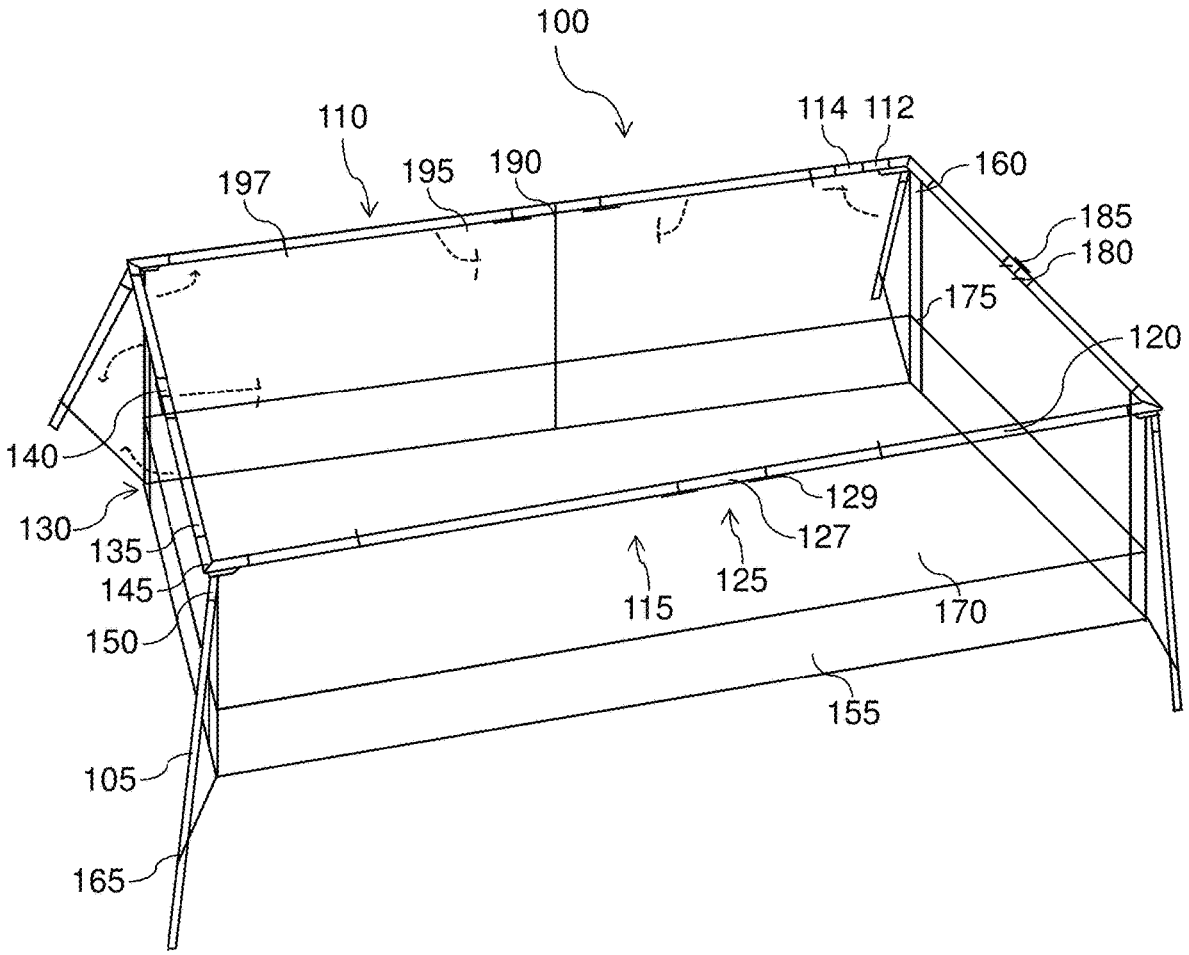
FIG. 1 shows, schematically and in perspective, a first specific embodiment of the foldable bed to which the present invention relates.

FIG. 1, which is not to scale, shows a cross-sectional view of an embodiment of the foldable bed (100) to which the present invention relates. This foldable bed (100) comprises:

- four legs (105),
- a frame (110) comprising:
  - two rods (115), referred to as "long", each comprising two straight, rigid rod sections, referred to as "primary", with lengths of the same order of magnitude, connected by a joint (125), referred to as "primary", in order to:
    - align the two primary rod sections (120) along the length of the rod sections (120) when the primary joint (125) is unfolded and
    - juxtaposing the two primary rod sections (120) when the primary joint (125) is folded,
  - two rods (130), referred to as "short", shorter than the long (115) rods, each comprising two straight, rigid rod sections (135), referred to as "secondary", with lengths of the same order of magnitude, connected by a joint (140), referred to as "secondary", in order to:
    - align the two secondary rod sections (135) along the length of the rod sections (135) when the secondary joint (140) is unfolded and
    - juxtapose the two secondary rod sections (135) when the secondary joint (140) is folded,
  - four joints (145), referred to as "tertiary", between a short rod (130) and a long rod (115), each tertiary joint (145) being configured such that:
    - when the tertiary joint (145) is folded, it juxtaposes said short rod (130) and said long rod (115) and
    - when tertiary joint (145) is unfolded, they position said short rod (130) and said rod (115) roughly perpendicular,
  - four joints (150), referred to as "quaternary", each attached to a primary rod section (120) or secondary rod section (135), each joint (150) being associated with a quaternary leg (105) and configured such that:
    - when the quaternary joint (150) is folded, they position said leg (105) in a position roughly parallel to said primary rod section (120) and
    - when quaternary joint (150) is unfolded, they position said leg (105) in a position roughly perpendicular to said primary rod section (120) and
- a flexible support (155) with an attachment (160) to the frame (110) to secure support (155) to frame (110) when the primary, secondary and tertiary joints respectively (125), (140) and (145) are unfolded.

The legs (105) are, for example, straight, rigid hollow tubes, in the form of right circular cylinders. These legs (105) have similar dimensions and each comprise two ends. At the first end, each leg (105) has a surface intended to be placed on a support surface, such as ground for example. In alternative embodiments, this surface is covered with an adhesive coating. At the second end, each leg (105) comprises an attachment, not shown, to a quaternary joint (150). This attachment is, for example, a screw passing through the quaternary joint (150) and the leg (105). In alternative embodiments, this attachment is an adhesive positioned between the quaternary joint (150) and the leg (105).

In alternative embodiments, each leg (105) includes a stop, not shown, near the end intended to be placed on the ground, this abutment being complementary to the attachment (165) of the support (155) and is used to tension the support (155). In these alternative embodiments, the attachment (165) is a cord wound and knotted around the leg (105) blocked by the abutment.

In alternative embodiments, the length of each leg (105) is roughly equal to the length of a section of primary rod (120).

The frame (110) serves as support for the flexible support (155). This frame is formed by two long rods (115) and two short rods (130) alternately connected to each other.

The two long rods (115) form the long sides of a cuboid. Each long rod (115) comprises two primary rod sections (120) connected by a primary joint (125). Each section of primary rod (120) has dimensions of the same order of magnitude. Each section of primary rod (120) is, for example, a straight, rigid hollow tube made of wood, plastic or metal.

Each primary joint (125) is, for example, a mechanism similar to a hinge. This mechanism comprises two arms, not shown, attached to a shaft, not shown, allowing the rotation of one arm with respect to the other, the rod serving as the axis of rotation for the arms. Each arm is mechanically associated with a primary rod section (120), such combination being effected by means of a screw or glue. In alternative embodiments, each arm is attached within a section of hollow primary rod (120). These primary joints (125) are limited to a movement of about 180° between the folded position and the unfolded position.

In alternative embodiments, at least one primary joint (125) comprises a rod section (127), referred to as "central", fitting into the two primary rod sections (120) associated with said joint (125), that section of central rod being associated with each said primary rod section (120) by a joint (129). The section of central rod (127) is, for example, a straight, rigid hollow tube, comprising, at each end, a method of connection, not shown, with a section of primary rod (120). This method of connection is, for example, a tube configured to fit into the section of primary rod (120) when the section of primary rod (120) is juxtaposed with the section of central rod (127), that is, when the joint (129) associated with said primary rod section (120) is unfolded. This joint (129) is, for example, a mechanism similar to a hinge. This mechanism comprises two arms, not shown, attached to a shaft, not shown, allowing the rotation of one arm with respect to the other, the rod serving as the axis of rotation for the arms. One arm is mechanically secured to the section of central rod (127) and the other arm is associated with a section of primary rod (120).

Each primary joint (125) is configured to:

align the two primary rod sections (120) along the length of the rod sections (120) when the primary joint (125) is unfolded and juxtapose the two primary rod sections (120) when the primary joint (125) is folded.

In order to maintain the primary joint (125) unfolded, a spring pin, not shown, can be implemented. This pin, contained in a section of primary rod (120), partially moves within another section of primary rod (120) or in a section of central rod (127) when the openings to the hollow sections of the primary rod sections (120), or a section of primary rod (120) and a section of central rod (127) are placed opposite each other.

Another way of maintaining the primary joint (125) unfolded consists in a user folding the primary joint (125) from an unfolded position, moving the primary rod sections (120) towards the ground, these primary rod sections (120) being maintained in position by the legs (105).

The two short rods (130) each comprise two straight, rigid rod sections (135), referred to as "secondary", having lengths of the same order of magnitude, connected by a joint (140) referred to as "secondary". The secondary rod sections (135) are similar to the primary rod sections (120), the length of these secondary rod sections (135) being less than the length of the primary rod sections (120). The secondary joints (140) are similar to the primary joints (125). These secondary joints (140) are configured to:

align the two secondary rod sections (135) along the length of the rod sections (135) when the secondary joint (140) is unfolded and juxtapose the two secondary rod sections (135) when the secondary joint (140) is folded.

In alternative embodiments, the secondary joints (140) fold towards the center of frame (110) such that the secondary rod sections (135) are parallel to the primary rod sections (120) when the secondary joint (140) is folded.

In alternative embodiments, the foldable bed (100) comprises a locking device (180) of the positioning of a secondary joint (140). This locking device (180) includes a push-button (180) configured such that, when the button (180) is pressed, it allows the transition of the secondary joint (140) from an unfolded position to a folded position. This push-button (180) acts, for example, as a stop preventing the rotation of a secondary rod section (135) when no pressure is exerted on the button (180).

In alternative embodiments, the locking device (180) comprises two push-buttons actuated by pressures in opposite directions, each push-button being positioned on the secondary joint (140). When each push-button is actuated, the secondary joint (140) can move from an unfolded position to a folded position by unlocking a rotation mechanism of secondary rods (135). These two push-buttons are actuated, for example, by the thumb and forefinger of an adult user.

In alternative embodiments, the locking device (180) includes a rotating means (185) of the secondary joint (140) about a longitudinal axis of the short rod (130). This rotating means (185) is, for example, embodied by the tubular nature of secondary rod sections (135) composing the short rod (130), those secondary rod sections (135) being rotatable in the housings, not shown, of the tertiary joints (145). When the secondary joint (140) is positioned such that an outward perpendicular traction of the surface on which the foldable bed (100) is placed is required, the secondary joint (140) is considered locked.

In order to connect the long rods (115) and the short rods (130), the foldable bed (100) has joints (145), referred to as "tertiary", each tertiary joint (145) being configured such that:

when the tertiary joint (145) is folded, it juxtaposes said short rod (130) and said long rod (115) and when the tertiary joint (145) is unfolded, it places said short rod (130) and said rod (115) in a roughly perpendicular position.

Each tertiary joint (145) is similar to the primary joints (125), these tertiary joints (145) being limited to a displacement of the order of 90° between the unfolded position and the folded position. When a tertiary joint (145) is folded, the associated primary rod section (120) is parallel to the primary rods (115).

In order to connect the leg (105) and the rest of the frame (110), the foldable bed (100) includes four joints (150), referred to as "quaternary", each attached to a primary rod section (120) or secondary rod section (135), each quaternary joint (150) being associated with a leg (105) and configured such that:

when the quaternary joint (150) is folded, they position said leg (105) in a position roughly parallel to said primary rod section (120) and when the quaternary joint (150) is unfolded, it places said leg (105) in a position roughly perpendicular to said primary rod section (120).

Each quaternary joint (150) is a mechanism similar to a joint attached to the frame (110) and to the leg (105), these quaternary joints (150) being limited to a displacement of the order of 90° between the unfolded position and the folded position. When a quaternary joint (150) is folded, the leg (105) associated with this quaternary joint (150) is juxtaposed with a primary rod (115). These quaternary joints (150) can be positioned such that the unfolded legs (105) have a non-zero angle of incidence relative to the ground.

Figure 5:
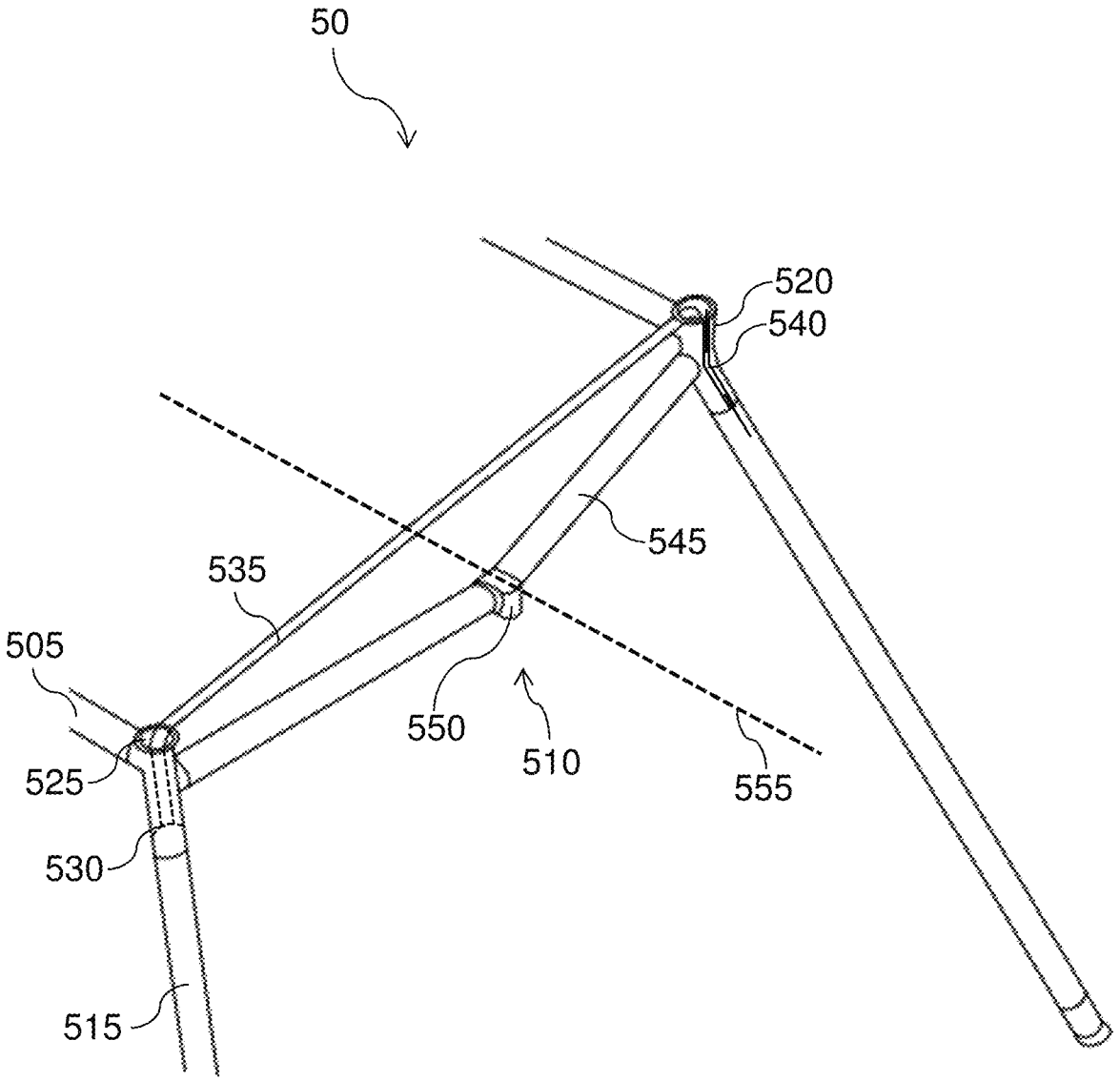
FIG. 5 shows schematically and partially in perspective, a third specific embodiment of the foldable bed to which the present invention relates.

In alternative embodiments, at least two quaternary joints are replaced by connections as described opposite FIG. 5. In these alternative embodiments, when the secondary joints are folded, the legs are no longer held against the connections.

The foldable bed (100) further comprises a flexible support (155) comprising an attachment (160) to the frame (110) to secure the support (155) to the frame (110) when the primary, secondary and tertiary joints (125), (140) and (145) are unfolded. The flexible support (155) is, for example, a surface referred to as "main", suspended to the frame (110), this surface comprising an attachment (165) at the base of at least one leg (105) when said leg (105) is unfolded. This surface is, for example, made of synthetic material.

The support (155) is configured to accommodate a removable mattress. The removable mattress is attached by a strap or a buttonhole. In the case of an attachment by a strap, the strap surrounds a section of the support (155) in order to retain the mattress against this support (155).

The attachment (160) is, for example, an assembly of straps surrounding a section of the frame (110) and supporting its surface. These straps are attached through mechanisms of the "hook-and-pile fastener" type or a zip, for example.

The attachment (165) is, for example, a cord configured to surround and be knotted around the leg (105).

In alternative embodiments, the support (155) includes an additional surface (170) suspended to the frame (110), positioned above the main surface (155). This additional surface (170) is removable and rollable, the support (155) comprising an attachment (175) for the additional surface (170). This additional surface (170) is, for example, formed by a fabric tensioned by slats. The attachment (175) is, for example, an assembly of abutments positioned along the straps, these abutments retaining the additional surface (170).

The support (155) further comprises flexible side barriers, not shown, between the main surface and the frame (110). These barriers prevent a child in the support (155) from leaving the support (155). These barriers, integrated with the support (155) include an opening/closing device (190) of the support (155). This opening/closing device (190) is, for example, a slide fastener through a barrier perpendicular to the floor.

The foldable bed (100) also includes an upper mesh (195) comprising a means (197) of attachment to the frame (110) for securing the support (155) to the frame (110) when the rods (115) and (130) of the frame (110) are unfolded. This mesh (195) is, for example, a mesh of synthetic fibers of the mosquito net type, this mesh (195) being attached to the frame (110) by means of the attachment (197), such as an assembly of hooks or a hook-and-pile fastener for example. This mesh (195) is positioned on an upper opening of the support (155). In alternative embodiments, the support (155) comprises a lateral mesh of dimensions less than 7 millimeters allowing a user to see inside the holder (155) without having to look through the upper opening of the support (155).

The frame (110) of the foldable bed (100) further includes a housing (112) for a lamp. In alternative embodiments, a leg (105) includes the housing (112) for a lamp.

The frame (110) of the foldable bed (100) further includes a housing (114) for a means of capturing images and/or sound. This means for capturing images and/or sound is, for example, a microphone and/or a camera. This microphone or camera can be connected to a portable terminal communicating with a remote user, for example. In alternative embodiments, the housing (114) is positioned on a leg (105).

In other embodiments, the housing (115) corresponds to a support for the means for capturing images and/or sound.

In alternative embodiments, the foldable bed (100) has a removable protective fabric against wind, insects or UV radiation attached to the frame.

In alternative embodiments, the foldable bed (100) includes a temperature sensor such as a thermometer, for example, mounted in the frame (110) associated with a display of temperature-related information. For example, if the temperature detected is greater than a predetermined high temperature, the display displays a red color. If the temperature is lower than a predetermined low temperature, the display displays a blue color. If the temperature is between the predetermined low temperature and the predetermined high temperature, the display shows a green color.

Figure 2:
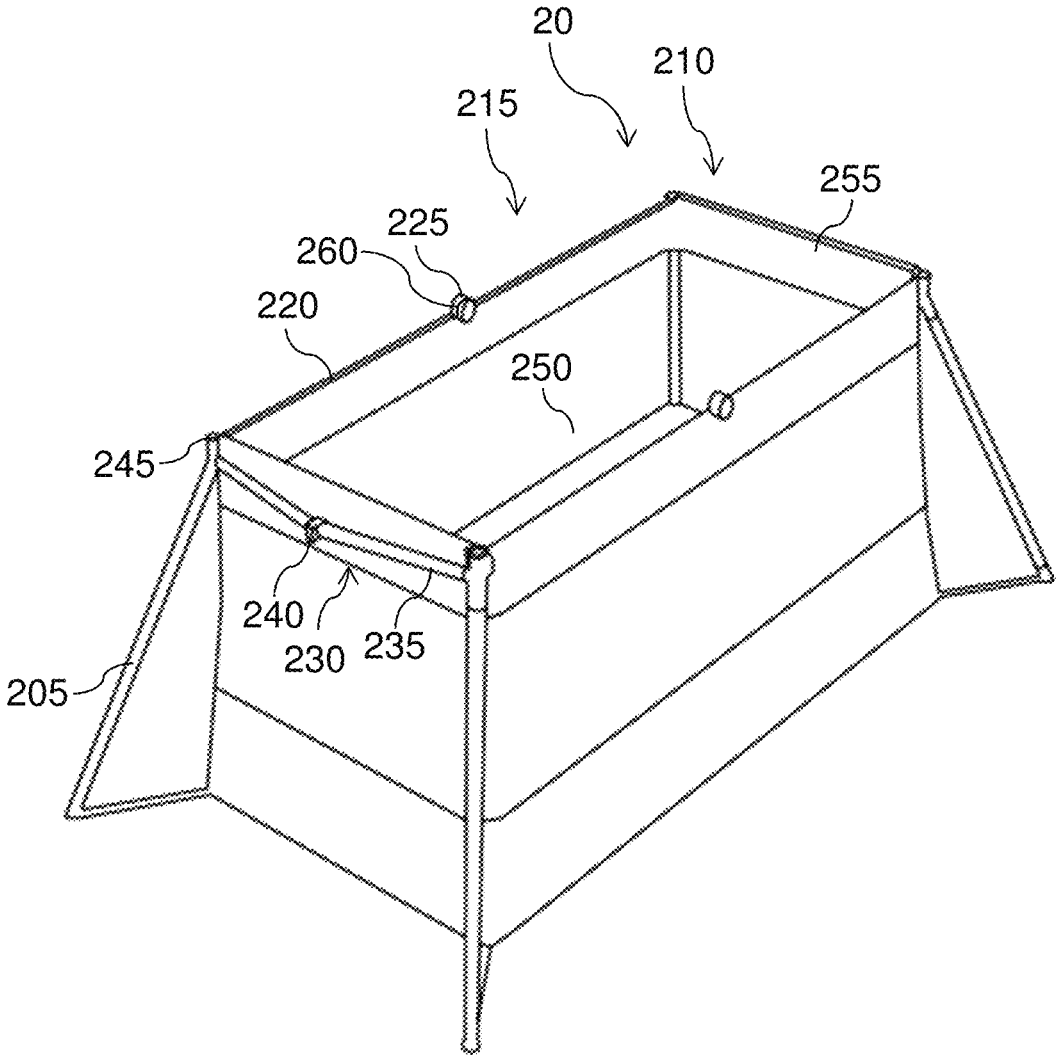
FIG. 2 shows schematically and in perspective, a second specific embodiment of the foldable bed to which the present invention relates.

FIG. 2 shows a particular embodiment of the foldable bed (20) to which the present invention relates. This foldable bed (20) comprises:

- four legs (205),
- a frame (210) comprising:
  - two rods (215), referred to as "long", each comprising two straight, rigid rod sections, referred to as "primary", with lengths of the same order of magnitude, connected by a joint (225), referred to as "primary", in order to:
    - align the two primary rod sections along the length of the rod sections when the primary joint is unfolded and
    - juxtapose the two primary rod sections when the primary joint is folded,
  - two rods (230), referred to as "short", each comprising two rod sections (235), referred to as "secondary", with lengths of the same order of magnitude, connected by a joint (240), referred to as "secondary", in order to:
    - align the two secondary rod sections along the length of the rod sections when the secondary joint is unfolded and
    - juxtapose the two sections of secondary rods when the secondary joint is folded,
  - a joint (245), referred to as "tertiary" between each short rod and each long rod, each tertiary joint being configured such that:
    - when the tertiary joint is folded, they juxtapose said short rod and said long rod and
    - when the tertiary joint is unfolded, position said short rod and said long rod roughly perpendicularly,
  - four joints (245), referred to as "quaternary", each attached to a section of the primary or secondary rod, each quaternary joint being associated with a leg and configured such that:
    - when the quaternary joint is folded, it positions said leg in a position roughly parallel to said section of the primary rod and
    - when the quaternary joint is unfolded, it positions said leg in a position roughly perpendicular to said section of primary rod and
- a flexible support (250) having a means of attachment (255) to the frame (210) to secure the support to the frame (210) when the primary, secondary and tertiary joints are unfolded.

In these embodiments, at least one primary joint (225) and/or secondary joint (240) has an ellipsoidal shape, the joint (225) and/or (240), being mechanically attached to a rod, primary (215) or secondary (235), associated with said joint, (225) and/or (240), and this joint (225) and/or (240), having a slot (260) allowing the movement of the other rod (215) and/or (235), associated with said joint, (225) and/or (240), around an axis perpendicular to the plane formed by said two rods, (215) or (235).

Figure 3:
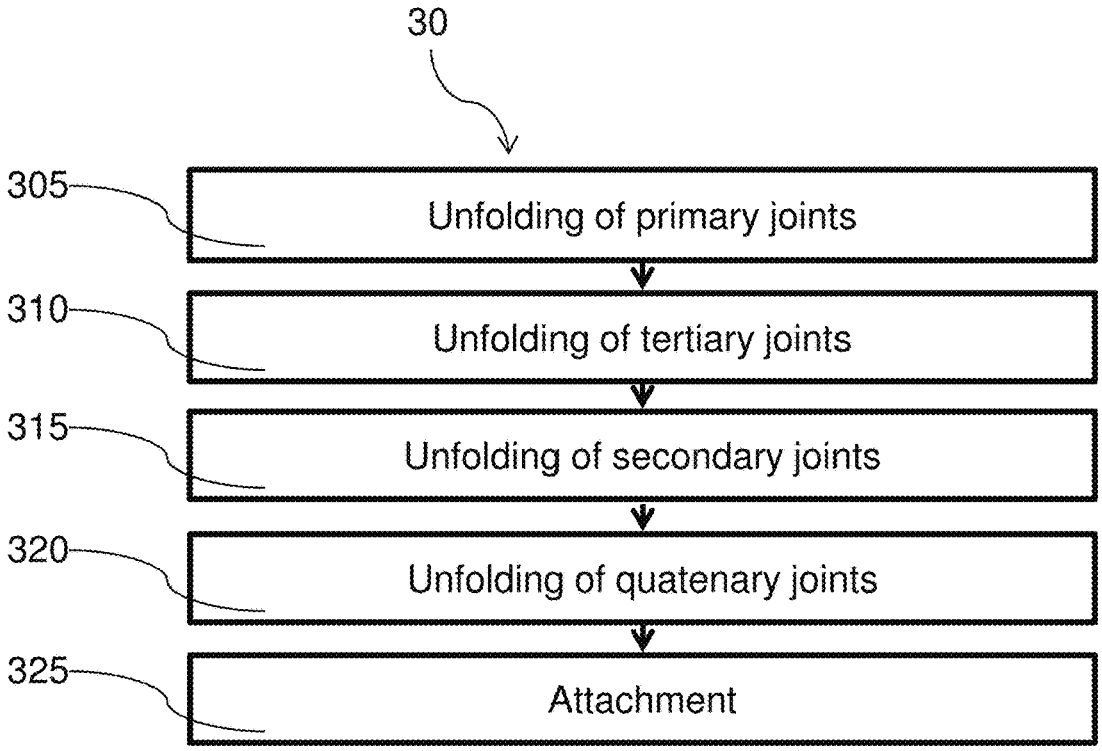
FIG. 3 shows schematically a first flowchart of the specific stages in the process to which the present invention relates, FIG. 4 schematically shows a second flowchart of the specific stages in the process to which the present invention relates.

FIG. 3 shows a particular embodiment of the process (30) to which the present invention relates. The extension process (30) of a foldable bed to which the present invention relates comprises:

- an extension stage (305) of the primary joints,
- an extension stage (310) of the tertiary joints,
- an extension stage (315) of the secondary joints,
- an extension stage (320) of the quaternary joints and
- an attachment stage (325) of the flexible support onto the frame unfolded as a result.

The extension stage (305) of the primary joints is carried out, for example, by a user applying a pressure on each primary joint. At the end of this extension stage (305), the long rods consisting of primary rod sections are aligned and the longer sides of the frame are formed.

The extension stage (310) of the tertiary joints is carried out, for example, by a user applying a pressure on each tertiary joint.

This extension stage (310) is carried out in conjunction with the extension stage (315) of the secondary joints. The extension stage (315) is carried out, for example, by a user applying a pressure on each secondary joint.

At the end of these extension stages (310) and (315), the sections of the short rods of which the secondary rods consist are aligned and the small sides of the frame are formed.

The extension stage (320) of the quaternary joints is carried out, for example, by a user applying a pressure on each quaternary joint. After this extension stage (320), the legs of the foldable bed are unfolded and make it possible to support the frame.

The attachment stage (325) is carried out, for example, by implementing straps supporting a flexible support of the foldable bed, these straps being fixed by means of a hook-and-pile fastener.

Figure 4:
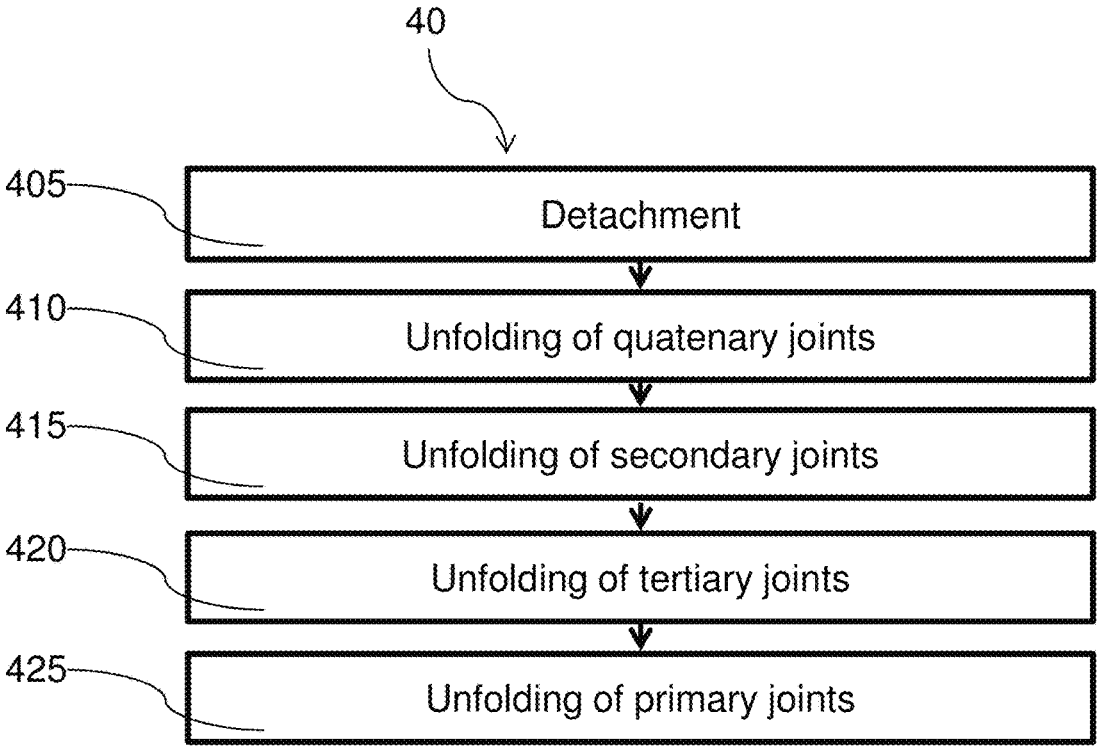

FIG. 4 shows a particular embodiment of the process (40) to which the present invention relates. This folding process (40) for a foldable bed to which the present invention relates comprises:

a release stage (405) of the flexible support on the unfolded frame, a folding stage (410) of the quaternary joints, a folding stage (415) of the secondary joints, a folding stage (420) of the tertiary joints and an extension stage (425) of the primary joints.

The release stage (405) is carried out, for example, by releasing the attachment of the support by a user, the release depending on the nature of the attachment.

The folding stages, (410), (415), (420) and (425), are carried out, for example, by a user applying a pressure on the joint such that the joints fold.

FIG. 5 shows a particular embodiment of the foldable bed (50) to which the present invention relates. This foldable bed (50) comprises:

a foldable frame (505) according to at least one axis (555) having at least one foldable rod (510), at least two legs (515), each leg being attached to the frame (505) by a connection (520), said connection (520) being used to position said leg (515) according to an unfolded position and to a folded position and the foldable rod (510) being associated with each connection (520) on either side of the folding axis (555), in which:

each connection (520) has an orifice (525) extending through said connection (520) and each leg (515) has an attachment (530) for a flexible wire (535) connecting two legs (515) and passing through the folding axis (555) of the frame (505), the wire (535) being tensioned when the rod (510) is unfolded, the tension of the wire (535) resulting the positioning of the legs (515) in the unfolded position, at least one orifice (525) has a shape, mechanically complementary to the shape of one end of the leg (515) associated with said connection (520), the connection (520) being configured to be engaged with said end, the orifice (525) has a concave shape, an opening (525) of the connection (520) being roughly positioned at the deepest point of said concave shape, another opening being formed by the base of the concave shape, the orifice (525) has the general shape of a cone, the base of the cone being oriented towards the end of the leg (515) associated with the connection (520), an opening of the orifice being positioned at the top of the cone, the connection (520) comprises, on one side, a longitudinal slot (540) connecting two openings of the orifice (525), this slot having a cross-sectional width less than the width of the wire (535) passing through the orifice and the foldable rod (510) comprises two sections (545) of straight rigid rod each associated with a connection (520), having lengths of the same order of magnitude, connected by a joint (550) in order to:

align the two rod sections (545) along the length of these sections (545) of rod (550) when the joint is unfolded and juxtapose the two rod sections (545) when the joint (550) is folded.

The frame (505) is, for example, a frame similar to the frames described opposite FIGS. 1 and 2. The frame has four foldable rods (510) forming a parallelogram, one leg (515) being attached to each corner of this parallelogram. This frame can be folded along an axis (555) by folding two parallel rods (510) or sequentially folded along two axes by folding the two parallel rods (510) before or after folding the two other parallel rods, not shown.

Unlike the mechanical joints connecting the legs to the rods in FIGS. 1 and 2, the attachment of two legs (515) to the frame (505) is obtained, in FIG. 5, by an assembly of connections (520), fasteners (530) of the legs (515) and a wire (535). In alternative embodiments, a combination of the fasteners in FIGS. 1, 2 and 5 is implemented to attach the legs to the frame.

The legs (515) are similar to the legs described opposite FIGS. 1 and 2 and each comprise, in addition, a fastener (530) to the wire (535). This attachment is, for example, an assembly formed by an abutment surrounding a recess of a leg (515), this abutment preventing a mobile or immobile part mechanically attached to the wire (535) from leaving the recess.

Each leg (515) has an attachment (530) for a flexible wire (535) connecting two legs (515) and (555) passing through the folding axis of the frame (505), the wire (535) being tensioned when the rod (510) is unfolded, the tension of the wire (535) leading to the positioning of the legs (515) in the unfolded position, At least two legs (515) are attached to the frame (505) via a connection (520). This connection (520) is, for example, a mechanical component integral with two rods including at least one foldable rod (510). This mechanical component comprises an orifice (525) passing through the component along an axis roughly perpendicular to the plane formed by the two rods integral with said component.

At least one orifice (525) has a shape, mechanically complementary to the shape of one end of the leg (515) associated with said connection (520), the connection (520) being configured to be engaged with said end. This shape is, for example, a concave shape, an opening (525) of the connection (520) being roughly positioned at the deepest point of said concave shape, another opening being formed by the base of the concave shape. In alternative embodiments, the orifice (525) has the general shape of a cone, the base of the cone being oriented towards the leg end (515) associated with the connection (520), an opening of the orifice being positioned at the top of the cone, The connection (520) comprises, on one side, a longitudinal slot (540) connecting two openings of the orifice (525), this slot having a cross-sectional width less than the width of the wire (535) passing through the orifice. This slot allows a user to position the wire (535) or to remove the wire (535) from the connection (520).

When the rod (510) is unfolded, the wire (535) is tensioned and the legs (515) are drawn by the tension of the wire (535) against the connections (520). When a leg (515) is secured to a connection (520), the leg (515) is said to be in the unfolded position. When a leg (515) is not secured to a connection (520), the leg (515) is in the folded position.

The foldable rod (510) is associated with two connections (520) on either side of the folding axis (555). This folding rod (510) comprises two sections (545) of straight and rigid rod each associated with a connection (520), having lengths of the same order of magnitude, connected by a joint (550) in order to:

align the two rod sections (545) along the length of these sections (545) of rod (550) when the joint is unfolded and juxtapose the two rod sections (545) when the joint (550) is folded.

The joint (550), for example, has a mechanism similar to a hinge.

Thus, as is understood on reading the description of FIG. 5, when a user unfolds the joint (550), the wire (535) is tensioned between the connections (520), which has the effect of establishing these connections (520) to the legs (515). Conversely, when a user folds the joint (550), the wire (535) is relaxed and the legs (515) become movable within the limits of the length of wire (535).

Figure 6:
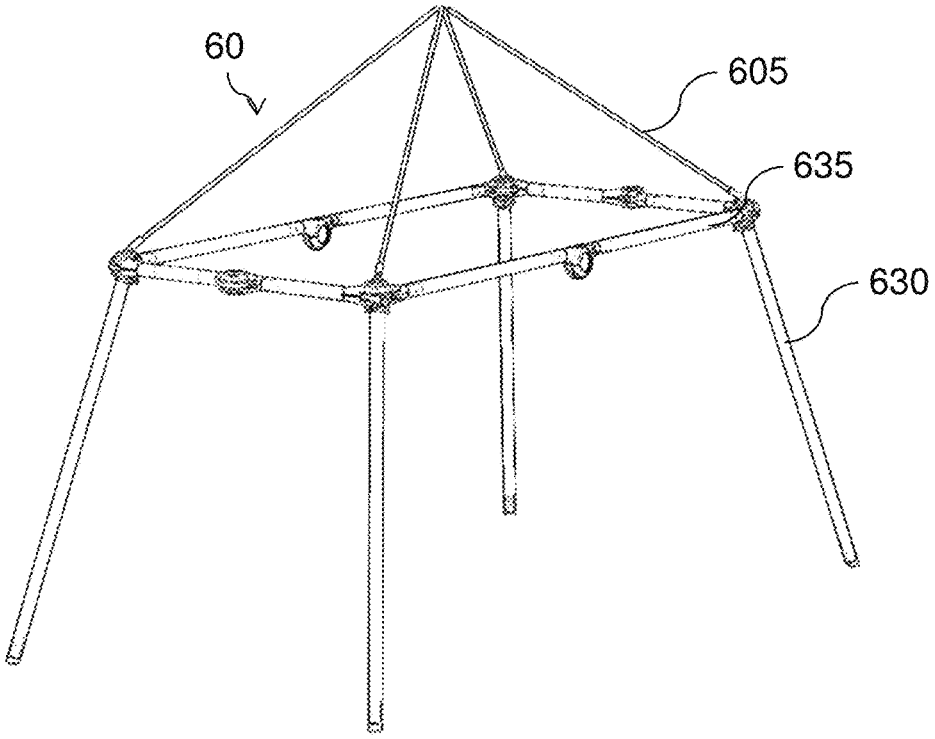
FIG. 6 shows schematically and in perspective, a specific embodiment of the bed to which the present invention relates.

FIG. 6 shows, schematically and in perspective, an embodiment of the bed (60) to which the present invention relates. This bed (60) comprises:

at least three legs (630) supporting a frame (635) and a support flexible (640), suspended from the frame (635) in a volume defined by the legs (630), the floor and section (635), having a top opening at the level of the frame (635) and on a lateral side of the support, opposite a volume delimited by two legs (630), a means (625) and (645) of opening a lateral opening on said lateral side.

The assembly formed by the legs (630), the frame (635) and the flexible backing (640) is, for example, similar to the legs (105) and the frame (110) of the bed (10) described opposite FIG. 1.

The support (640) is similar to support (155) of the bed (10) described opposite FIG. 1. This support (640) is, in alternative embodiments, configured to accommodate a mattress on a lower face.

Figure 8:
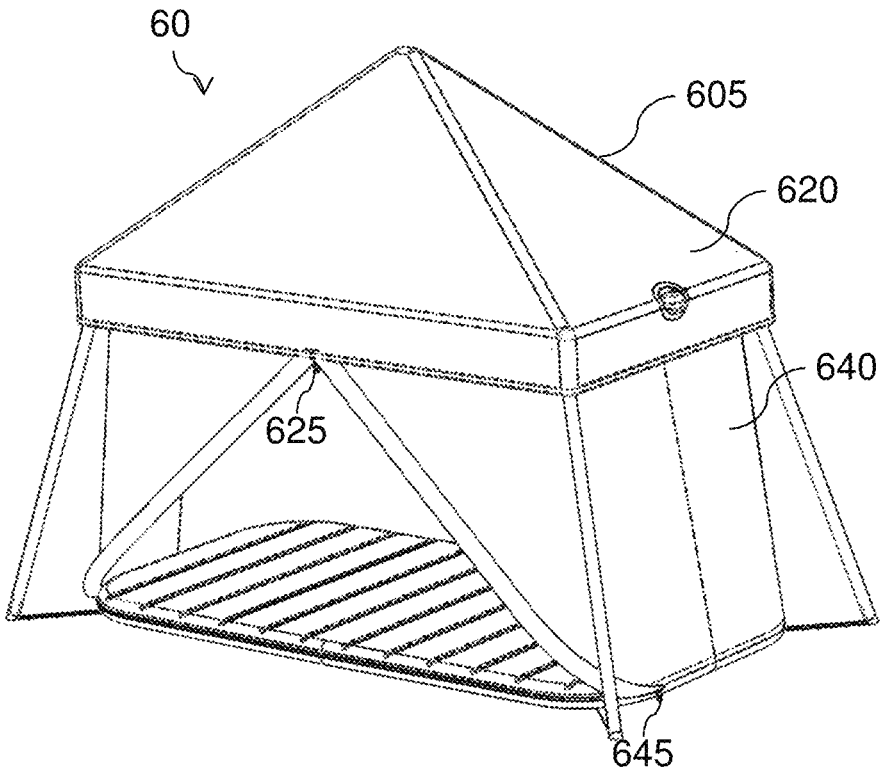
FIG. 8 shows schematically and in perspective, a specific embodiment of the bed to which the present invention relates.

FIG. 8 shows the opening means, (625) and (645) of a lateral opening of the support (640) is, for example, formed by an assembly of slide fasteners.

a vertical slide fastener (625) passing through the lateral side and at least one horizontal slide fastener (645) along a lower section of the support (640).

The slide fastener (625) forms, for example, a vertical axis of symmetry of the lateral side. Preferably, when the slide fastener (625) is open to the maximum, the lateral opening has a height roughly equal to the height of the support (640).

Each horizontal slide fastener (645) is attached on the one hand, to a lower section of support (640), or to a mattress on the bottom, and on the other to a mesh forming the lateral side. Preferably, when each fastener, (625) and (645), is in the closed position, the slide fasteners, (625) and (645), are in contact.

When the bed (60) comprises only one fastener (645), the lateral opening forms a right-angled triangle, the rectangle angle being positioned at the junction of the axes of displacement of the fasteners, (625) and (645).

When the bed (60) has two fasteners (645), the lateral opening forms a triangle of which the axis of displacement of the fastener (625) corresponds to the height of the triangle relative to the side formed by the collinear axes of displacement of the fasteners (645).

In alternative embodiments, the axis of at least one fastener (645) completely surrounds the lower section of the support (640) such that, when this path is taken by said fastener (645), the lower section is detached.

In alternative embodiments, as shown in FIG. 8, a lower section of the support (640) is coplanar with the plane formed by the lower ends of each leg (630).

Figure 7:
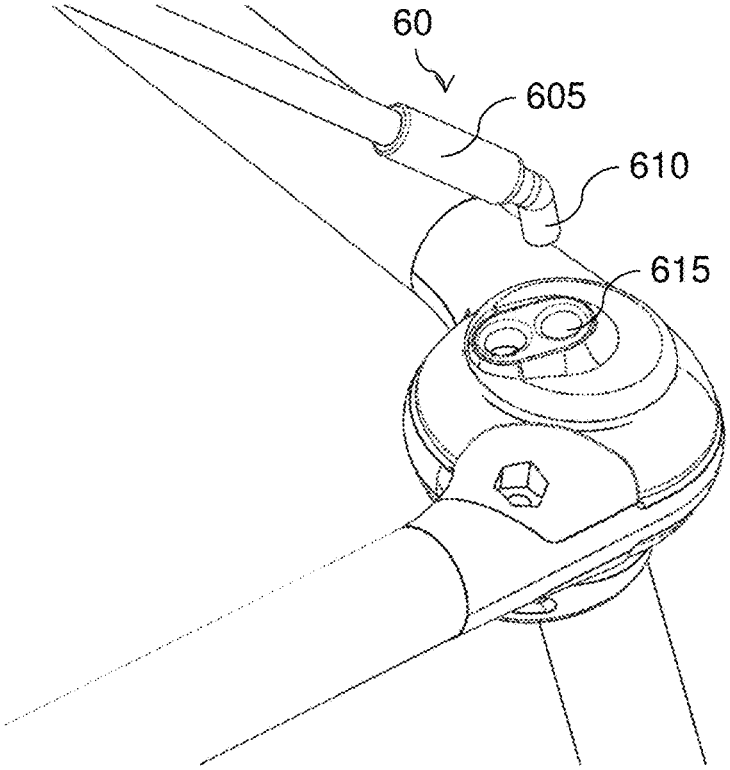
FIG. 7 shows schematically and in perspective, a specific embodiment of the bed to which the present invention relates.

In alternative embodiments, as shown in FIG. 7, at least one rod (605) attached to the frame (635) and forming a support for the bed roof (620).

Each rod (605) has, for example, a tubular shape.

In preferred embodiments, each rod (605) has, at one end, a means (610) for attachment to the frame (635). This attachment (610) is, for example, a protrusion configured to be attached in a recess of a frame member (635).

When the bed in which the rod (605) is to be attached is a bed (10) as described opposite FIG. 1, this attachment takes place, for example, at the level of a tertiary joint (145).

In alternative embodiments, as shown in FIG. 7, the bed (60) comprises at least two rods (605) connected by an end forming, in the folded position, a parallel bundle of rods.

The connecting end is the other end of the unused tube (610) as a means of attachment.

In alternative embodiments, as shown in FIG. 8, the bed (60) comprises a bed roof (620) configured to cover at least the frame (635) and the upper opening of the flexible support (640).

Figure 9:
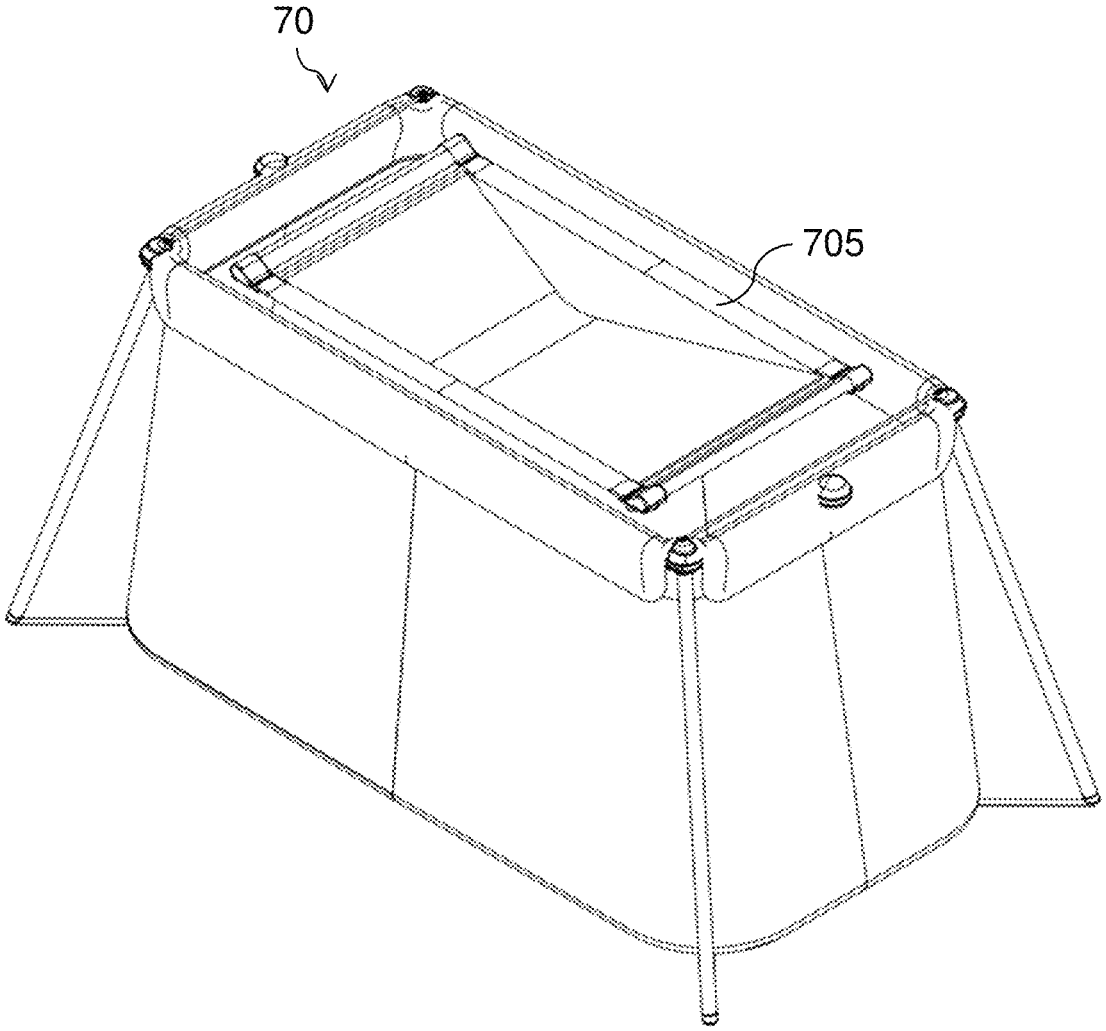
FIG. 9 shows schematically and in perspective, a specific embodiment of the bed to which the present invention relates.

FIG. 9 shows a particular embodiment of the bed (70) to which the present invention relates. This bed (70) has a changing table (705) supported by the bed frame (70). This changing table (705) is, for example, a surface of synthetic or natural fabric. Preferably, this changing table (705) has, in the position attached to the frame, a cavity for placing and holding the child. This changing table (705) is configured to be removable by a releasable attachment to the bed frame (70). This attachment of the changing table (705) above the bed can be a series of securing straps, or plastic connecting pieces clipped onto the target.

This changing table (705) allows the child to be changed at the right height without a parent of the child having to bend and risk a back injury.

This changing table (705) may also act as a hammock or general support for the child. In this way, the child can be changed or put in a play position, at table height, in comfort.

Note that the term "slat" is not limited to a strip form but can also designate any volume having a length at least five times greater than the width and height of the volume. This volume having a cross-section along an axis which may take the form of a circle, a "U" shape, a square for example.

Also note that the figures are not to scale.

Figure 10:
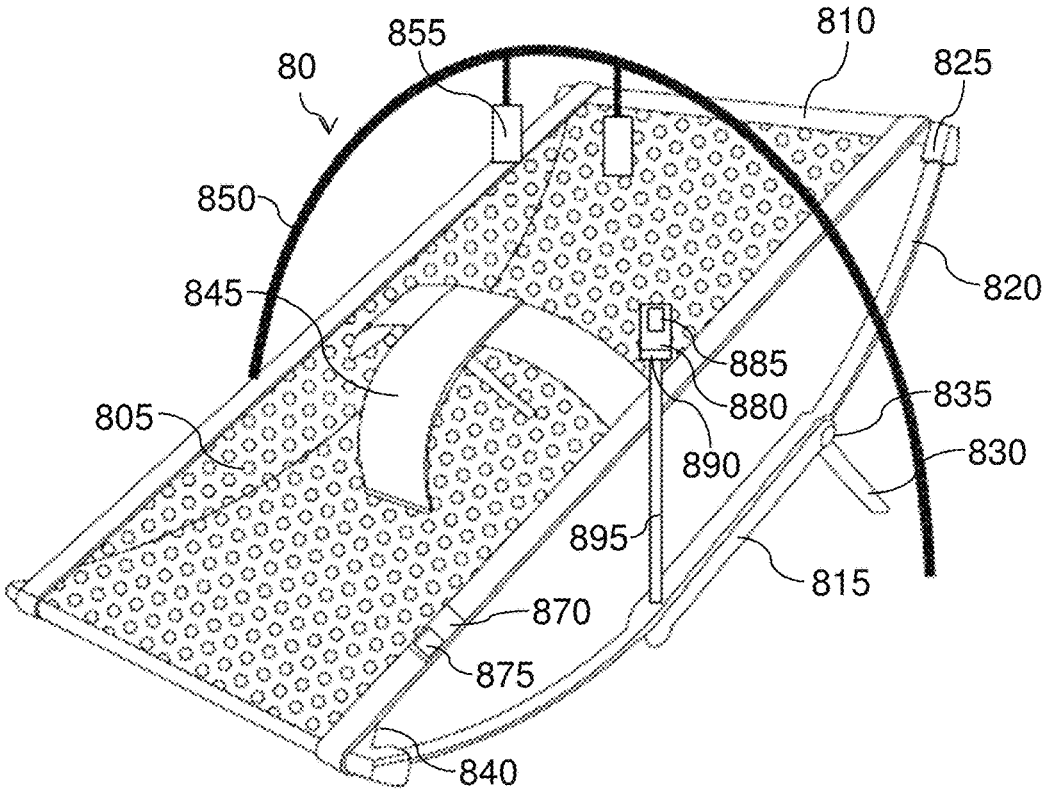
FIG. 10 shows, schematically and in perspective, a first specific embodiment of the recliner to which the present invention relates.

FIG. 10, which is not to scale, shows a cross-sectional view of one embodiment of the recliner (80) to which the present invention relates. This foldable recliner (80) comprises:

fabric (805) connected to two rods (810), two supports (815) of flexible slat each comprising at least one removable means of attachment (835) to a slat (820) and four means (825) for attaching a slat (820) or support (815) to one end of a different rod (810) to form a rigid frame.

The fabric (805) is, for example, knitted cloth of natural or synthetic material of rectangular shape of which two opposite faces are each connected to a rod (810). This connection is formed, for example, by the addition of a self-gripping strip, known to those skilled in the art under the name of "hook-and-pile fastener" on one side of the fabric (805) in order to be hung to a complementary strip positioned on the same side of the fabric (805). In alternative embodiments, the fabric (805) is sewn around each rod (810). In these alternative embodiments, the connection (840) of the fabric (805) to the rods (810) is removable.

The fabric (805) presents, preferably, a concave shape when the rods (810) are removed. This form is obtained, for example, by the positioning of seams on the fabric (805) causing stretching of sections of the fabric (805) only when the rods (810) are moved apart.

In alternative embodiments, the connection is formed by an assembly of eyelets and hooks (not shown) allowing the attachment of the fabric (805) about a rod (810).

Each rod (810) is, for example, a bar made of plastic, metal or wood. Each rod (810) includes two means for attaching (825) slats (820) or slat (820) holders (815).

In alternative embodiments, at least one rod (810) is telescopic, which allows a reduction in length when the recliner (80) is in the folded position.

The attachments (825) are, for example, rigid end caps attached to each end of a rod (810), these caps comprising a cavity to accommodate a mechanical section projecting from a support (815) or the end of a slat (820).

In alternative embodiments, at least one attachment (825) is a magnet associated with a piece of metal or another magnet attached to a slat (820) or support (815).

In alternative embodiments, each attachment (825) is a notch formed in a rod (810) such that the attachment can be obtained directly between at least one slat (820) and the rod (810). This notch may be surrounded by a strap of fabric (805) tensioned by a slat (820) attached to the rod (810)

Each slat (820) support (815) is, for example, a casing having at least one housing for a slat (820), each slat sliding in a housing from a retracted position in the housing, to an unfolded position. This casing has, for example, a roughly parallelepiped shape. This support (815) is formed, for example, by attachment by screwing or gluing of two half-supports (815) made of molded plastic.

In alternative embodiments, each support (815) comprises a mechanical protrusion at one end to be fitted in a cavity of an attachment (825).

In preferred embodiments, each support (815) has two slots (820) for each slat, the direction of movement of each slat (820) from a retracted position to an unfolded position being opposite to each other.

Each slat (820) is, for example, a foldable blade made of metal or plastic. Each foldable blade slides into a housing in order to be pushed or are extracted by the action of a user. In the retracted position, a section of the blade protrudes from the housing in order to be pulled by a user. In alternative embodiments, at least one slat (820) comprises a mechanical component for attachment to a complementary mechanical component of a rod (810) or attachment (825).

In alternative embodiments, at least one slat (820) compresses a spring in the retracted position and is held by a movable stop. When a user presses a button positioned on the support (815), coupled to the slat (820), the stop is moved and the spring pushes the slat (820), part of which is thus projecting from the support (815), which allows a user to grip and extract the slat (820) from the housing.

When a slat (820) is in the unfolded position, a mechanical stop prevents the slat (820) from being retracted from the housing without a manual displacement of the stop by a user.

The attachment of each slat end (820) and/or support (825) serves to stiffen the fabric (805) by keeping the rods (810) spaced apart.

In alternative embodiments, as shown in FIG. 10, the length of each assembly formed by a slat (820) support (815) and each associated slat (820) is greater than the maximum length of spacing between the rods (810), the attachment of each slat (820) thus causing the bending of said slats (820) to form an arc. This arc is then used to support the recliner (80) on a surface such as a floor for example.

In alternative embodiments, as shown in FIG. 10, each slat (820) support (815) comprises an unfoldable leg (830) attached by a hinge to said support (815).

This leg (830) is, for example, a rigid rod of plastic or metallic material. This leg (830) is positioned in the folded position, against the support (815). The hinge has for example a maximum rotation angle of the leg (830) about the axis of this hinge.

In alternative embodiments (not shown), each slat (820) is attached to the support (815) when the recliner (80) is the folded position and disassembled then attached to the attachment (835) when the recliner (80) is in the unfolded position. The attachment (835) is, for example, a mechanism for clipping or screwing the slat (820) to the support (815).

In alternative embodiments (not shown), each slat (820) is associated with a support (815) by a hinge acting as removable attachment (835). In the folded position, each slat (820) is positioned within a housing of the support (815), the slats (820) being rotationally moved about the joint to achieve the extension of the slats (820). The hinge may comprise a non-return clipping device for locking the slat (820) in rotation at a position corresponding to the unfolding/folding of this slat (820). This non-return device can be deactivated by pressing a push-button removing the non-return device from contact with the slat (820).

In alternative embodiments (not shown), the attachment (835) is a sliding joint, allowing a slat (820) to slide, passing from a retracted storage position to a position of use outside the support housing (815).

In alternative embodiments (not shown), the assembly formed by a support (815) and at least one slat (820) forms a single integral block, the slats (820) not then being removable from the holder (815).

In alternative embodiments, each slat (820) is independent of the support (815) and attached thereto in order to form an integral block.

In alternative embodiments, an elastic band passes through a support (815) and each associated slat (820), the support (815) and associated slats (820) having the shape of tubes joined by rigid cylinders. The length of the elastic band is selected such that the elastic band is tensioned when a support (815) and the associated slats (820) are joined by rigid cylinders.

In alternative embodiments, as shown in FIG. 10, the fabric (805) includes a harness (845). This harness (845) allows the attachment in position of a child positioned against the fabric (805). This harness (845) is, for example, a harness in three or five points of attachment with straps and quick clips.

In alternative embodiments, as shown in FIG. 10, the recliner (80) includes an arc (850) elements (855) mobile support hanging next to the fabric (805). This arc (850) is, for example, formed by one or more rods made of plastic or metallic material, this arc (850) being configured to at least partially cover the wire (805).

This arc (850) is attached to the fabric (805), at least one slat (820), to at least one support (815) or to a surface on the recliner support (80).

This arc (850) has at least one suspended mobile element (855), this element (855) being, for example, a toy or plush positioned within reach by touch of a child positioned against the fabric (805).

In alternative embodiments, this arc (850) has a rectangular or polygonal shape.

Figure 11:
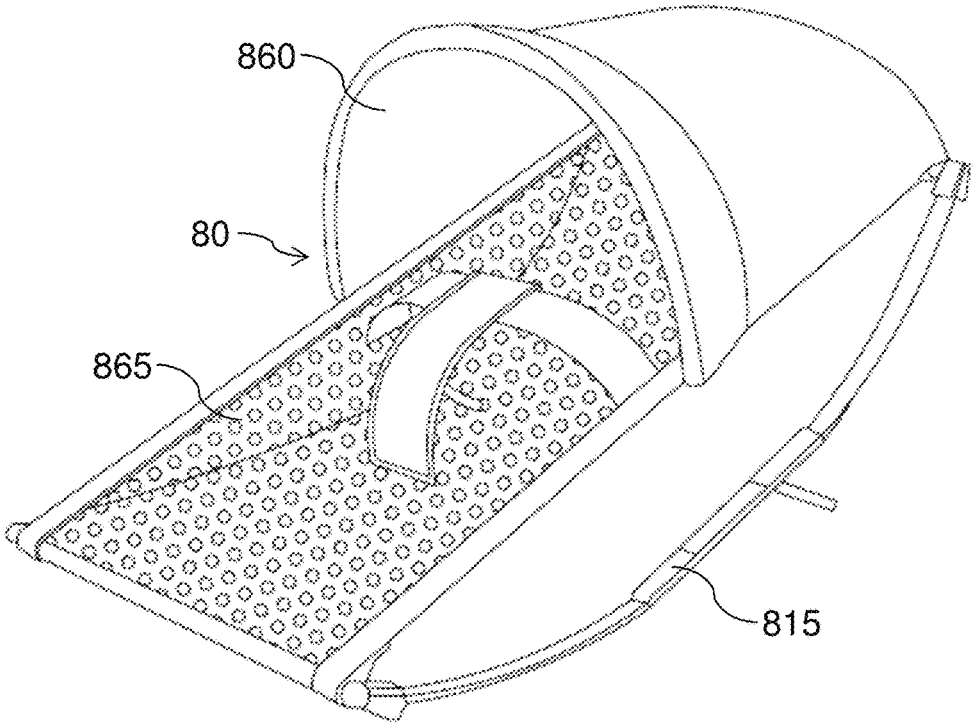
FIG. 11 shows, schematically and in perspective, the first specific embodiment of the recliner to which the present invention relates.

In alternative embodiments, as shown in FIG. 11, the recliner (80) includes an awning (860) of removable protection, fixable to the fabric (805) or slat (820) supports (815), covering at least one section of the fabric (805).

This awning (860) is, for example, a flexible structure roughly in the shape of two half-shells attached to the fabric (805) or the supports (815) of slat (820). This awning (860) comprises, for example, a fabric at least partially opaque filtering out ultraviolet light.

Figure 12:
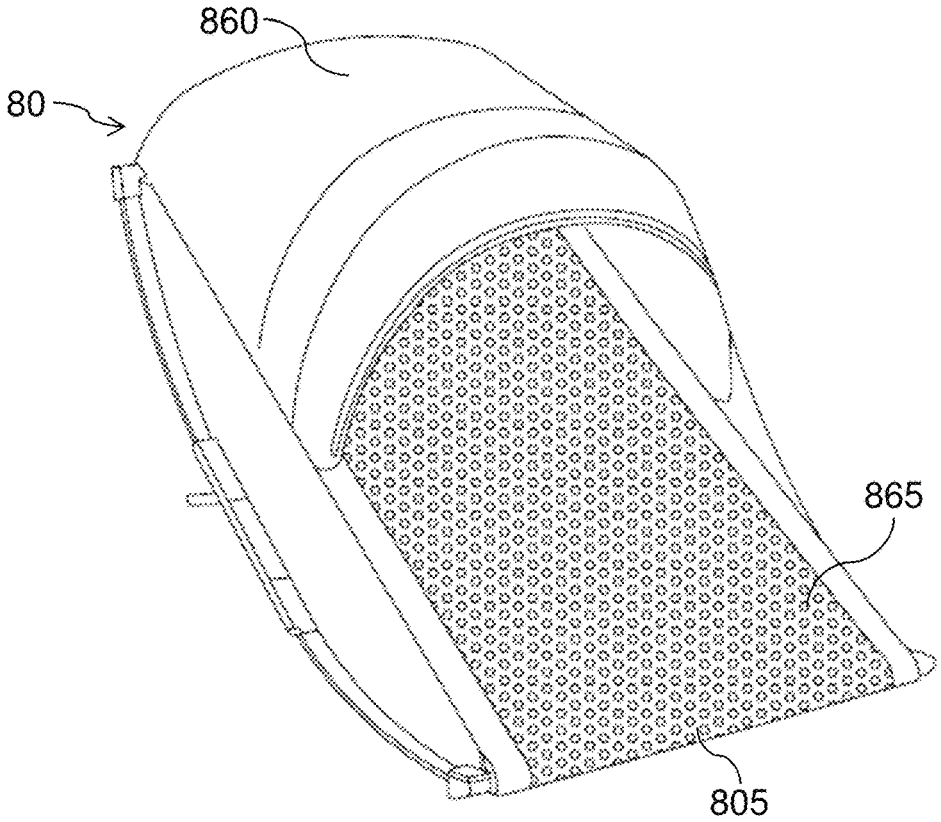
FIG. 12 shows, schematically and in perspective, the first specific embodiment of the recliner to which the present invention relates.

In alternative embodiments, as shown in FIG. 12, the recliner (80) includes a knitted fabric (865), attached to the awning (860) and the fabric (805), covering another section of the fabric (805) than the section covered by the awning (860).

The knitted fabric (865) is attached to the awning (860) and to the fabric (805) by a system of hook-and-pile fasteners or clips, for example. The mesh of the knitted fabric (865) preferably should have a spacing preventing an insect of the mosquito type from crossing the knitted fabric (865).

In alternative embodiments, this knitted fabric (865) is impregnated with insecticide.

In alternative embodiments, as shown in FIG. 10, the recliner (80) comprises a means (870) for detecting the temperature near or on the recliner (80) and means (875) for signaling information representative of the temperature detected.

The temperature detection means (870) is, for example, an electronic thermometer positioned on one of the components of the recliner (80).

The signaling means (875) is, for example, a pellet changing color according to the temperature detected due to the effect of the temperature or the effect of a command issued by the means of detection (870).

In alternative embodiments, this signaling means (875) is a display screen of information representative of the temperature detected.

In alternative embodiments, this signaling means (875) is a light emitting diode emitting a light signal depending on the temperature detected.

In alternative embodiments, the signaling means (875) is an antenna configured to transmit a wireless signal to a remote terminal, the wireless signal comprising information representative of the temperature detected or by the temperature detected crossing a predetermined limit value. This antenna is, for example, configured to transmit according to the Bluetooth standard, IEEE 802.11 referred to as "Wi-Fi" or radio frequencies.

In alternative embodiments, as shown in FIG. 10, the recliner (80) includes an image sensor (880) attached to a slat (820) support (815) and means (885) for transmitting the captured images.

The image sensor (880) is, for example, an optical sensor attached to a mechanical component (895) attached to a slat (820) support (815). When this image sensor (880) is powered, image capturing is carried out continuously. In alternative embodiments, the capture image (880) is dependent upon detection of a vibration or a sound signal in the vicinity.

This image sensor (880) is, in alternative embodiments, removable.

The transmitting means (885) of the captured images is, for example, an antenna configured to transmit a wireless signal to a remote terminal, the wireless signal including information representative of at least one captured image. This antenna is, for example, configured to transmit according to the Bluetooth standard, IEEE 802.11 referred to as "Wi-Fi" or radio frequencies. In alternative embodiments, this antenna is part of the antenna implemented to provide the signaling means (875).

In alternative embodiments, as shown in FIG. 10, the recliner (80) includes a means of orienting (890) the controlled image sensor (880) depending on the reception of a steering command.

The means of orientating (890) the image sensor (880) is, for example, a freely-rotating mechanical component supporting the image sensor (880) rotated by a motor (not shown). The actuation of the motor is controlled by receiving a steering command for the image sensor (880) by a means of reception (not shown). The means of reception is, for example, an antenna configured to receive a wireless signal including information representative of a steering command. This antenna is, for example, configured to transmit according to the Bluetooth standard, IEEE 802.11 referred to as "Wi-Fi" or radio frequencies. In alternative embodiments, this antenna is part of the antenna implemented to provide the signaling means (875) or to provide the transmission means (885).

In alternative embodiments, the image sensor (880) is movable along two orthogonal axes of rotation.

The steering command is transmitted, for example, by connecting a portable terminal of a user, such as a smartphone or a digital tablet for example.

In alternative embodiments, the received command includes a command:

- to transmit a continuous stream of images,
- to periodically transmit images,
- to modify the image transmission frequency and/or
- to modify an activation parameter of the image sensor (880).

In alternative embodiments, an antenna implemented is configured to transmit a wireless signal including information representative of a state of charge of an autonomous power source supplying one of the devices of the recliner (80).

Figure 13:
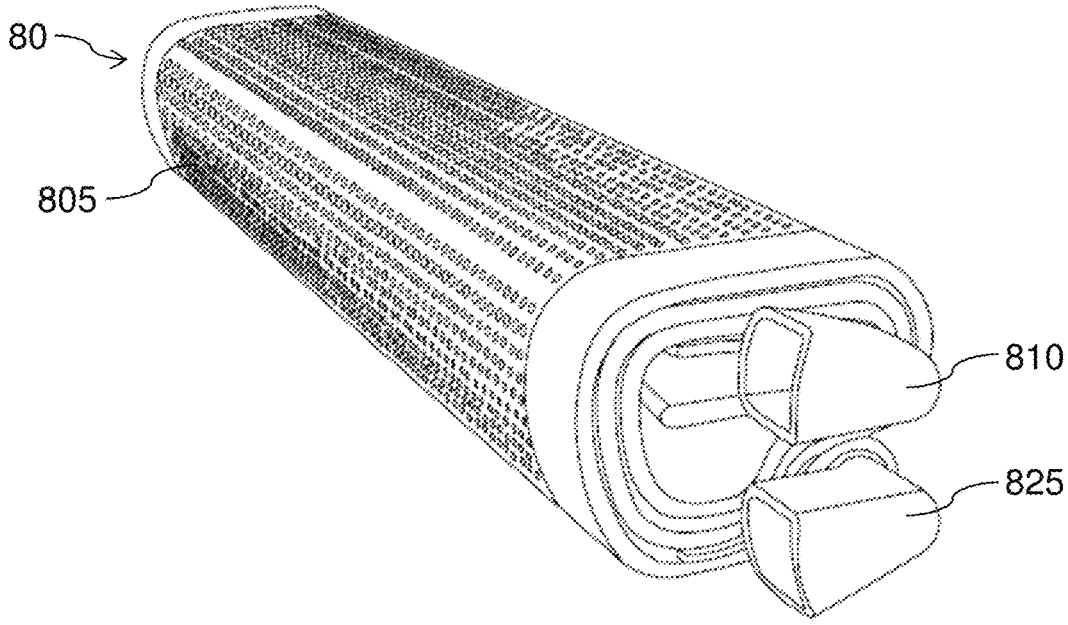
FIG. 13 shows, schematically and in perspective, the first specific embodiment of the recliner, the to which the present invention relates, in the folded position.

FIG. 13 shows the assembly formed by the fabric (805) and rods (810) in the folded position.

Figure 14:
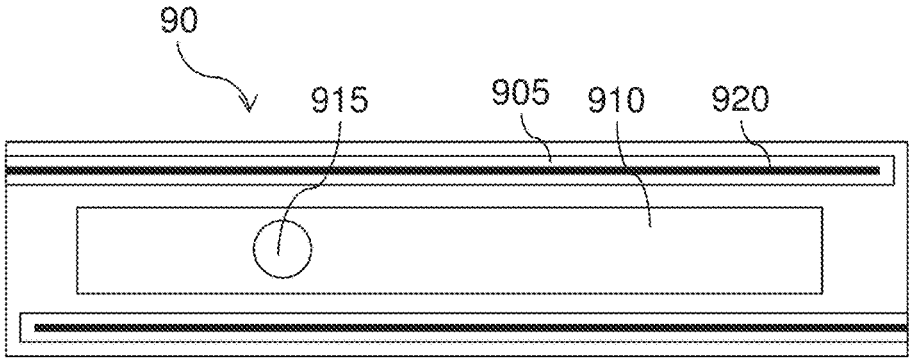
FIG. 14 shows schematically and in section, a second specific embodiment of the recliner to which the present invention relates.

FIG. 14, which is not to scale, shows schematically and in a cross-sectional view, a particular embodiment of the support (90) for the slats (920) of a recliner (80) to which the present invention relates. In FIG. 14, the support (90) is in the folded position.

This support (90) comprises:

- two housings (905) for slats (920), the slats (920) sliding in an opposite direction relative to each other,
- a leg (910) attached to a hinge (915).

The leg (910) has a width similar to the width of the housings such that, when the slats (920) are unfolded, the leg (910) may exit the interior of the support (90). When the slats (920) are retracted, the leg (910) is caught between the two slats (920).

Figure 15:
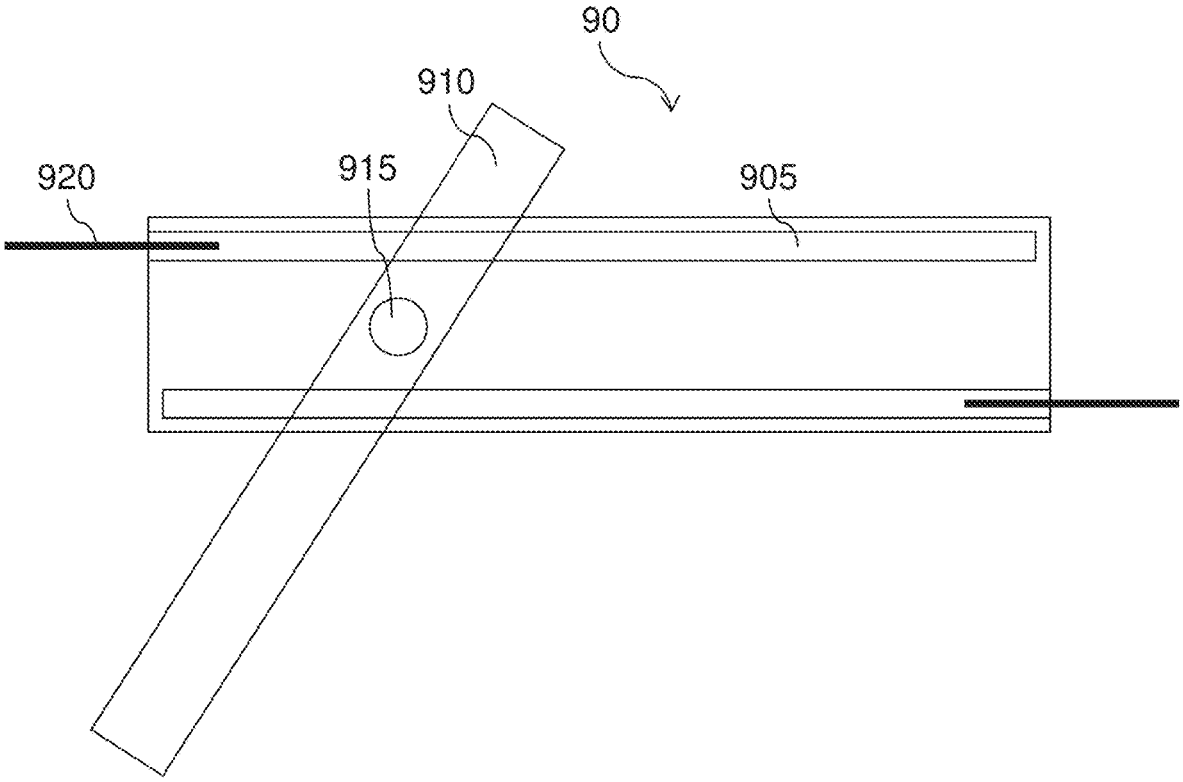
FIG. 15 shows schematically and in cross-section, the second specific embodiment of the recliner to which the present invention relates

FIG. 15, which is not to scale, shows schematically and in a cross-sectional view, the support (90) when the slats (920) are unfolded and the base (910) is extended.

Figure 16:
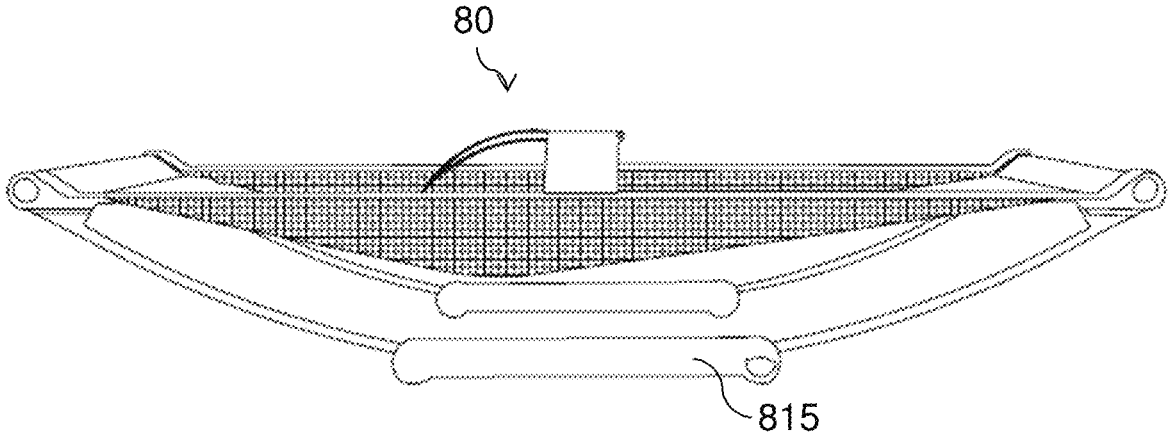
FIG. 16 shows, schematically and in profile, the first embodiment of the recliner to which the present invention relates.

FIG. 16, which is not to scale, shows schematically and seen from the side, the device (80) as described opposite FIG. 10 in which the leg (830) is folded into the slat (820) support (815).

Thus, as can be understood on reading the present description, the recliner (80) to which the present invention relates has reduced dimensions in the folded position. In addition, the weight of the recliner (80) is considerably lower than the weight of recliners usually used. Thanks to these arrangements, the recliner (80) is compatible with the "EN 82790" standard on recliners.

The invention claimed is:

1. Foldable bed comprising:

a foldable frame having at least one foldable rod including a joint foldable along at least one folding axis between a folded position and an unfolded position;

at least two legs, each leg having an end being engageable to a connection member, attached to the rod, for coupling the leg to the rod , said connection member having an orifice passing therethrough, said connection member is disposed on either side of the folding axis and is configured to selectively engage said end of said leg in said unfolded position, each leg further includes an attachment member positioned inside said leg;

a flexible wire extending between the two legs and being directly attached to the attachments inside said two legs, said flexible wire passes through the folding axis of the rod and through the orifice of each connection member;

wherein said flexible wire is configured such that when said joint is in said unfolded position the flexible wire is tensioned and each of the legs is drawn by the tension of the wire towards said connection member and is thereby secured to the connection member, and when said joint is in said folded position the flexible wire is relaxed and the legs are movable with respect to the connection members and while maintained being coupled to the frame by the wire through the orifice of the connection member and the rod.

2. Foldable bed according to claim 1, wherein at least one orifice has a shape, mechanically complementary to the shape of one end of the leg associated with said connection, said connection being configured to be fitted with said end.

3. Foldable bed according to claim 2, wherein the orifice has a concave shape, an opening of the connection being roughly positioned at the deepest point of said concave shape, another opening being achieved by the base of the concave shape.

4. Foldable bed according to claim 2, wherein the orifice has the general shape of a cone, the base of the cone being oriented towards the end of the associated with the connection, an opening of the orifice being positioned at the top of the cone.

5. Foldable bed according to claim 1, wherein the connection comprises, on one side, a longitudinal slot connecting two inlets of the opening, said slot having a cross-sectional width less than the width of the wire passing through the orifice.

6. Foldable bed according to claim 1, wherein the foldable rod comprises two straight, rigid rod sections each associated with a connection, having lengths of the same order of magnitude, connected by a joint in order to:

align the two rod sections along the length of these rod sections when the joint is unfolded and juxtapose the two rod sections when the joint is folded.

7. Bed according to claim 1, which comprises:

at least three legs supporting the frame and a flexible support, suspended from the frame in a volume defined by the legs, the floor and the frame, having a top opening at the level of the frame and on one lateral side of the support opposite a volume delimited by two legs, an opening means, a lateral opening on said lateral side.

8. Bed according to claim 7, wherein a lower section of the support is coplanar with the plane formed by the lower ends of each leg.

9. Bed according to claim 7, wherein the opening means comprises:

a vertical slide fastener passing through the lateral side and at least one horizontal slide fastener lying along a lower part of the support.

10. Bed according to claim 7, which comprises at least one rod attached to the frame and forming a support for the bed roof.

11. Bed according to claim 10, which comprises a bed roof configured to cover at least the frame and the upper opening of the flexible support.

12. Foldable bed according to claim 1, which comprises:

four legs, the frame comprising:

two rods, referred to as "long", each comprising two straight, rigid rod sections, referred to as "primary", with lengths of the same order of magnitude, connected by a joint, referred to as "primary", in order to:

align the two primary rod sections along the length of the rod sections when the primary joint is unfolded and juxtapose the two primary rod sections when the primary joint is folded, two rods, referred to as "short", shorter than the long rods, each comprising two straight, rigid rod sections, referred to as "secondary", with lengths of the same order of magnitude, connected by a joint, referred to as "secondary", in order to:

align the two secondary rod sections along the length of the rod sections when the secondary joint is unfolded and juxtapose the two sections of secondary rods when the secondary joint is folded, four joints, referred to as "tertiary" between a short rod and a long rod, each tertiary joint being configured such that:

when the tertiary joint is folded, they juxtapose said short rod and said long rod and when the tertiary joint is unfolded, position said short rod and said long rod roughly perpendicularly, four joints, referred to as "quaternary", each attached to a section of the primary or secondary rod, each quaternary joint being associated with a leg and configured such that:

when the quaternary joint is folded, it positions said leg in a position roughly parallel to said section of the primary rod and when the quaternary joint is unfolded, it positions said leg in a position roughly perpendicular to said section of primary rod and a flexible support including a means for attachment of the frame to secure the support onto the frame when the primary, secondary and tertiary joints are unfolded.

13. Foldable bed according to claim 12, wherein each leg has a length roughly equal to the length of a section of primary rod.

14. Foldable bed according to claim 12, wherein the support is a surface, referred to as "main", suspended to the frame, said surface including a means for attachment to the base of at least one leg when said leg is unfolded.

15. Foldable bed according to claim 14, wherein the support comprises an additional surface, suspended to the frame positioned above the main surface.

16. Foldable bed according to claim 15, wherein the additional surface is removable and rollable, the support comprising a means for attachment of the additional surface.

17. Foldable bed according to claim 12, which includes a locking device comprising a push-button configured such that, when a pressure is applied to the button, it allows the transition of the secondary joint from an unfolded position to a folded position.

18. Foldable bed according to claim 12, which includes a means of opening/closing the support.

19. Foldable bed according to claim 12, wherein at least one primary joint and/or secondary joint has an ellipsoidal shape, this joint being mechanically connected to a primary or secondary rod, associated with said joint, the joint comprising a slot allowing the movement of the other rod associated with said joint about an axis perpendicular to the plane formed by the two said rods.

20. Foldable bed according to claim 1, wherein the attachment member of each one of said legs is disposed inside the respective leg, and said flexible wire extends to said attachment member through said orifice.

* * * * *